US005882104A

United States Patent [19]

Oliver

[11] Patent Number: 5,882,104

[45] Date of Patent: Mar. 16, 1999

[54] CANDLE HOLDER/TOY SURPRISE

[76] Inventor: Carlos P. Oliver, 9051-C Siempre Viva Rd., Suite MX-37-143, San Diego, Calif. 92173

[21] Appl. No.: 56,286

[22] Filed: Apr. 7, 1998

[51] Int. Cl.[6] ..... F21V 35/00

[52] U.S. Cl. ..... 362/161; 362/808; D26/12

[58] Field of Search ..... 362/431, 382, 362/389, 392, 393, 161, 806, 808, 810; 431/296; D26/10, 12

[56] References Cited

U.S. PATENT DOCUMENTS

| | | | |
|---|---|---|---|
| 155,450 | 9/1874 | Keitel | 431/296 X |
| D. 166,428 | 4/1952 | Todd . | |
| 2,072,692 | 3/1937 | Valle | 362/161 |
| 2,499,079 | 2/1950 | Steinhilb | 431/296 X |
| 2,696,037 | 12/1954 | Pernici . | |
| 2,697,042 | 12/1954 | Lemrow . | |
| 2,834,685 | 5/1958 | Ferguson . | |

*Primary Examiner*—Stephen Husar
*Attorney, Agent, or Firm*—D. Peter Hochberg

[57] ABSTRACT

A two-in-one candle holder toy surprise having a candle holder portion with a bottom surface affixable to a toy surprise portion. The candle holder toy surprise has a candle holder mode when in its upright position and a toy mode in its inverted position. The candle holder portion functions as a base for the toy surprise when in the toy surprise mode. The toy surprise portion has a flat extending longitudinal surface and acts as an anchor for the candle holder portion when in the candle holding mode.

17 Claims, 7 Drawing Sheets

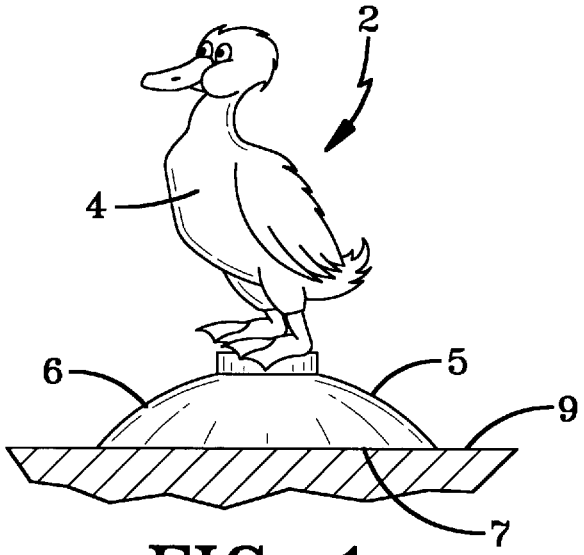
FIG-1
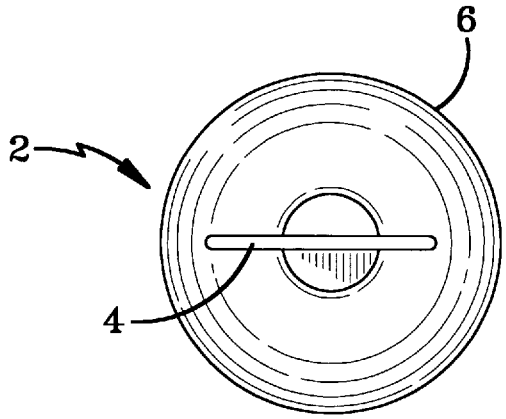
FIG-3
FIG-2
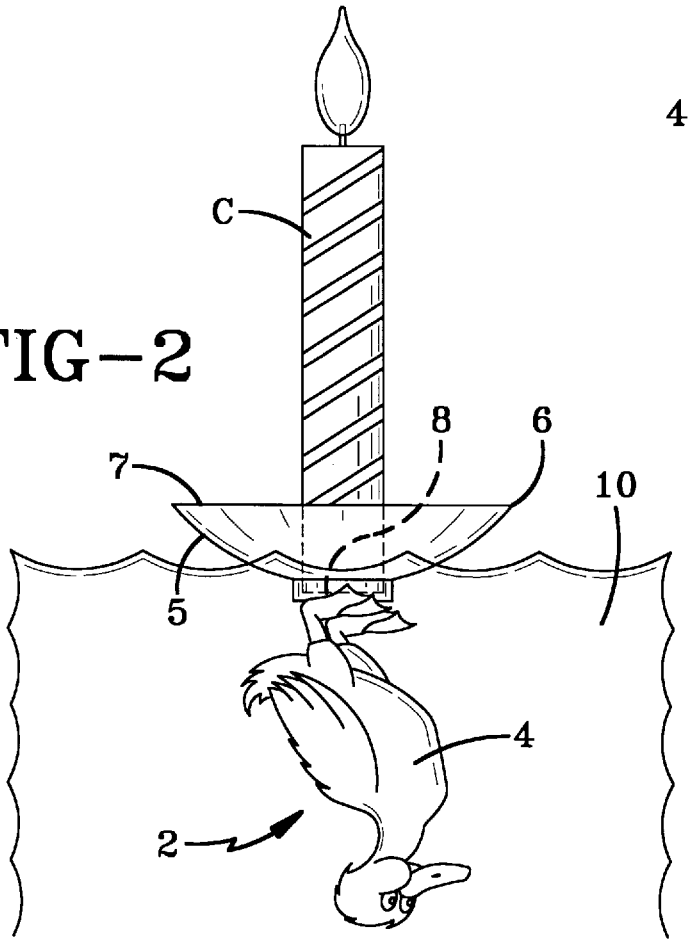

CANDLE HOLDER/TOY SURPRISE

BACKGROUND OF THE INVENTION

1. Field of the Invention

The present invention relates generally to candle holders for candles, for example, festive candles such as birthday candles, and more particularly to a device having a candle holder facing in one direction and having a figure such as a toy, a message or other item, facing the opposite direction. The device is thus adapted to function as a candle holder in a birthday cake or the like, and can also function as a surprise toy for children or adults.

2. Description of Prior Art

Toy figures have been known in the art for a very long time. However, none of the existing figure toys can be used to secure birthday candles in a birthday cake or the like. Candle holders for birthday cakes have also been known in the art for a long time. However these type of holders usually use a cylindrical straight pin or a cylindrical shaft to secure the candle holders to the cake. The pin or shaft of traditional candle holders needs to be significantly long to provide sufficient anchoring of the candle holder. This leaves a deep round hole in the cake when the candle holders are removed. These deep round holes are also left in the cake when a candle holder is not used and the candle is placed into the cake without a candle holder.

Combination candle holder and cake inserts are known. For example, U.S. Pat. No. 2,696,097 discloses a candlestick designed for a double use. The first use is to allow the candlestick to stand alone on a flat surface, while the second use is for allowing the candlestick to be inserted into a cake. This is accomplished by providing a cup-like insert for the candle that has a recess on the bottom surface of the cup. A stand is provided that has a pointed end and a large rounded flat end. The rounded flat end includes a pointed piece inside a larger cup-like opening adapted to receive the recess of the cup-like insert. The insert can be connected to the pointed end while the round end can be placed on a flat surface. The insert can also be placed in the point inside the large round end and the pointed end placed in a cake. This device cannot act as a toy surprise.

Further, animated figurines, as cake inserts are known. U.S. Pat. No. 2,697,042 discloses a novelty cake and stand. The stands are designed to accept a decorative figure. The cake has a central opening for receiving the stand. The stand could be inserted into a cake not having a hole in the center but this would destroy the cake and frosting. The figurine is too large to act as a toy surprise for inserting into a cake. Further, it could not act as a candle holder.

It is known to combine toys with holders for holding food such as ice cream. U.S. Pat. No. 2,834,685 discloses a combination confection holder toy boat. The confection holder is designed to hold frozen ice or ice cream on the stick. The bottom piece is designed as a toy boat and a collector for melted ice or ice cream. The convection holders can support small masts after the ice or ice cream is consumed. This patent shows an ice cream holder having an aesthetic and functional bottom piece. The reference does not show a candle holder with an aesthetic holding portion. Additionally, the toy portion would be inappropriate for inserting into a cake.

None of the candle holders currently known in the art have a dual function, where they are used to hold birthday candles in a cake and act as a surprise toy for children.

SUMMARY OF THE INVENTION

In accordance with a preferred embodiment of the present invention, the invention is a two-in-one candle holder toy surprise. The candle holder toy surprise includes a candle holder portion for holding a birthday candle, and a toy surprise portion or entertainment portion for entertaining children. The candle holder toy surprise acts as a candle holder when inserted into a cake or the like, and acts as a toy for children when it is in its reverse position. While appearing as an ordinary candle holder, the child is surprised when the candle holder is removed from the cake and the child discovers a hidden toy on its underside.

The candle holder portion holds a candle while operating in the candle holder mode, and also functions as a base for holding the toy surprise portion in the reverse position on a flat surface when operating in the toy mode. The toy surprise portion is generally long and flat with an irregular shape such as that of an animal, a cartoon character or an object such as a flower, a car, an aircraft or any other figure or word capable of entertaining a child. It also could have a message, such as "Happy Birthday." The generally long flat irregular surface of the toy portion extends in the longitudinal direction of the candle holder toy surprise and functions as an anchor to secure the candle holder portion in place. The irregular shape and extended surface enhances the gripping effect, and the ability of the candle holder to better secure the birthday candle in place, when the toy portion is inserted into a cake or the like. The thin flat surface makes it easy to insert the toy surprise portion into a cake or the like because it works similar to a thin knife during insertion. The thin flat surface leaves only a straight small cut similar to one produced by a very thin knife, when the candle holder toy surprise is removed from the cake, as opposed to other candle holders or candles that leave a large hole in the cake when they are removed. In some instances, depending on the texture of the cake, the thin cut is many times not observable.

In a preferred aspect of the invention, the candle holder portion is comprised of a dome-like or bowl-like shape with an upper round surface and a lower flat surface. The flat surface of the candle holder can act as a base to hold a toy surprise in an upright position when operating in the toy mode. The round surface can catch melted wax from the candle when positioned in the candle holding mode.

In another preferred aspect of the invention, the candle holder portion includes a socket cavity for receiving and securing a candle in the candle holding mode. The invention may include a cavity having a number of inner flanges having various diameters and surface heights for receiving candles of varying sizes.

In another aspect of the invention, the candle holder portion secures the candle when inserted into the candle holder portion by using a cavity and/or another feature. The other feature could take on the form of upwardly extending fingers, or a sharp pin extending upward from the cavity receiving the candle. The candle holder portion could also secure the candle by a coil or spring or using an adhesive surface.

In yet another aspect of the invention, the toy surprise portion is a series of alphabet, numeric or alpha-numeric characters spelling sayings appropriate for a birthday or other occasion. The candle holder portion can take on a symmetrical or asymmetrical shapes. The above discussed aspects of the invention could also be combined in a single two-in-one candle holder toy surprise.

An object of the invention is to provide a candle holder that also acts as a toy surprise for children.

Another object of the invention is to provide a candle holder that has an extended surface that improves the grip of the candle holder when inserted in a cake or the like.

A further object of the invention is to provide a candle holder that produces a cleaner cut when inserted into a cake or the like than conventional candle holders or candles inserted by themselves.

Another object of the invention is to provide a candle holder that can be used also as a game for children.

Yet another object of the invention is to provide a candle holder that also includes a funny entertaining saying for children or adults.

Another object of the invention is to provide a candle holder that can receive candles of varying sizes.

An additional object of the invention is to provide a candle holder that can prevent wax dripping from a burning candle from falling on the cake or the like that the candle is placed on.

Another object of the invention is to provide a candle holder that has better securing methods than conventional candle holders for preventing a candle from falling over or leaning to the side when placed on a cake or the like.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein:

FIG. 1 is a front view of a preferred embodiment of the invention in an inverted or reverse position.

FIG. 2 is a front view of a preferred embodiment of the invention in an upright position.

FIG. 3 is a bottom view of a preferred embodiment of the invention.

DETAILED DESCRIPTION OF PREFERRED EMBODIMENT

Figure 4:
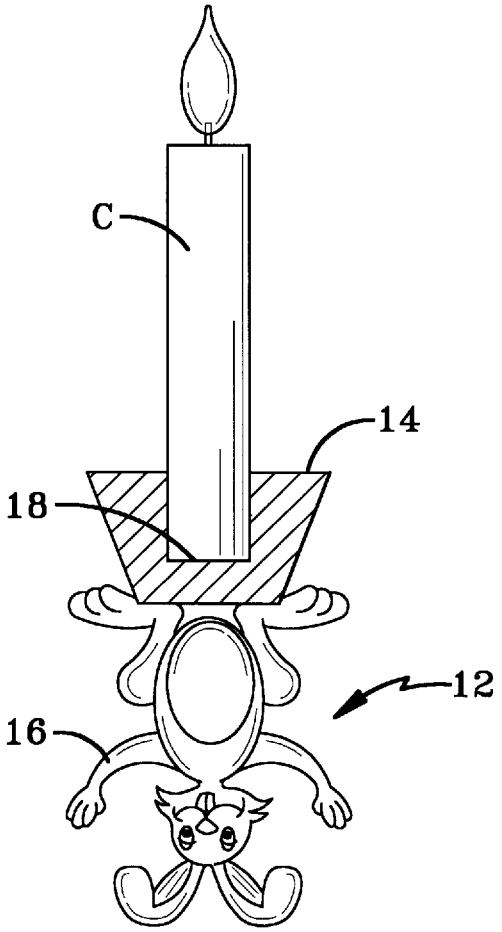
FIG. 4 is a cross-sectional view of a preferred embodiment of the invention having an inner socket cavity in the candle holder portion.

Referring now to the drawings wherein the showings are for the purpose of illustrating the preferred embodiment of the invention only, and not for the purpose of limiting same, FIG. 1 shows a two-in-one candle holder toy surprise 2 having a toy surprise portion 4 in the shape of an animated character or cartoon. Toy surprise portion 4 is attached to a dome-like candle holder portion 6. The dome-like candle holder portion has a rounded upper surface 5 and a flat bottom surface 7. Candle holder portion 6 acts as a base to allow toy surprise 2 to stand upright on a flat surface 9. A bottom view of the toy surprise is shown in FIG. 3. As shown, toy surprise portion 4 has a long flat longitudinal surface. The thin flat surface extends longitudinally and allows the toy surprise to easily be inserted into a cake or the like, and easily removed from a cake or the like with little or no damage to the cake.

It should be appreciated that flat surface could be raised or curved to provide decorative features to the toy surprise portion. The flat surface could be decorated by imprinting ink on one or both sides or using decorative stickers. The toy surprise portion and candle holding portion are preferably made of plastic, but could be made of metal, glass, paperboard, or wood (with provisions being made to protect against having the portions accidentally burn). The entire candle holder toys surprise could be made on one of these materials, or the candle holder portion and the toy surprise portion could be made of different materials.

In FIG. 2, the two-in-one candle holder toy surprise is depicted in its candle holding mode. The two-in-one candle holder toy surprise 2 is its upright position and toy surprise portion 4 is inserted into cake 10. The extended surface of toy surprise portion 4 acts as an anchor holding the candle holder portion 6 in place. Candle holder portion 6 remains above the surface of the cake. Candle holder portion 6 includes a socket-like cavity adapted to receive candle C. Rounded upper surface 5 now forms a cup that can catch melted wax droppings from candle C during burning. This prevents wax droppings form falling onto the cake.

It should be appreciated that the base and toy can be permanently affixed to the candle holder or be temporarily affixed. The toy surprise can be temporarily affixed to the candle holder by forming a slot in the bottom surface of the candle holder and inserting the bottom of the surprise toy portion into the slot. Many other methods could be employed for temporarily affixing the toy surprise portion to the candle holder portion. This would also allow for interchanging of toy surprises in a single candle holder or the interchanging of candle holder portions with a single toy portion.

Figure 5:
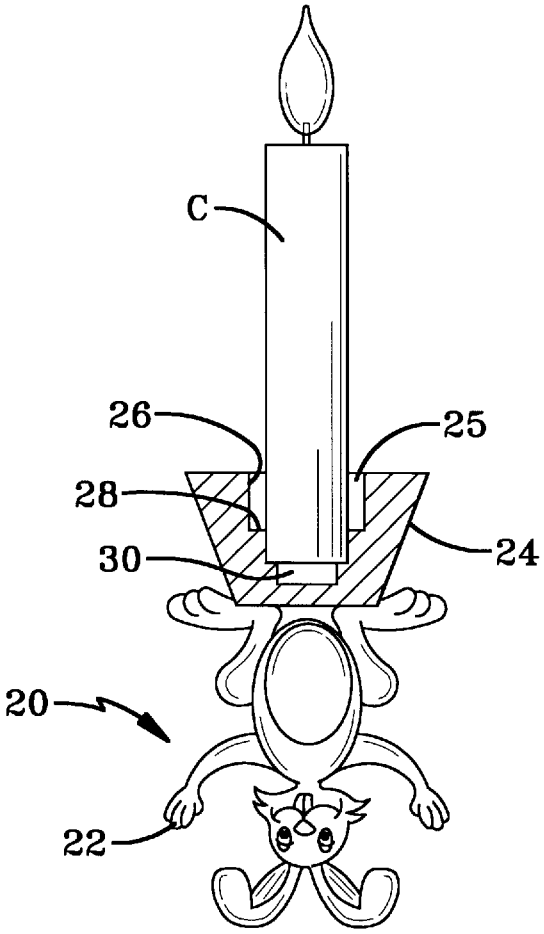
FIG. 5 is a cross-sectional view of a preferred embodiment of the invention having an inner socket cavity in the candle handle portion having multiple inner flanges of varying diameters.

As can be appreciated, the candle holder portion of the invention is not limited to dome-shaped candle holder portions, but can take on a variety of shapes and configurations. As shown in FIG. 4, a two-in-one candle holder toy surprise 12 has a toy surprise portion 16 and a candle holder portion 14 shaped like a flower pot. Candle holder portion 14 includes socket like cavity 18 for receiving a candle C. Additionally, the candle holder portion may be adapted to receive a variety of candle sizes. As shown in FIG. 5, two-in-one candle holder toy surprise 20 has a toy surprise portion 22 and a candle holder portion 24. Candle holder portion 24 has a socket cavity 25 having interior cylindrical surfaces 26, 28 and 30 having different diameters for accepting candles having varying diameters.

Figure 6:
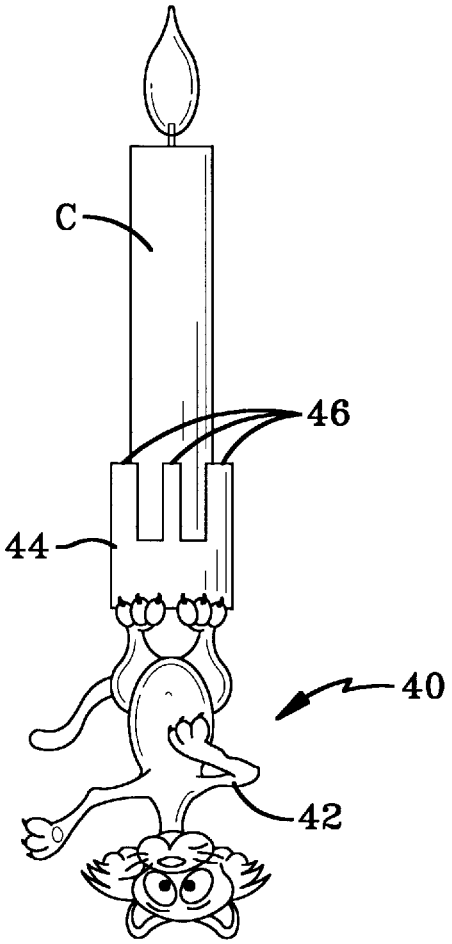
FIG. 6 is a front view of a preferred embodiment of the invention having a candle portion with upwardly extending fingers.
Figure 7:
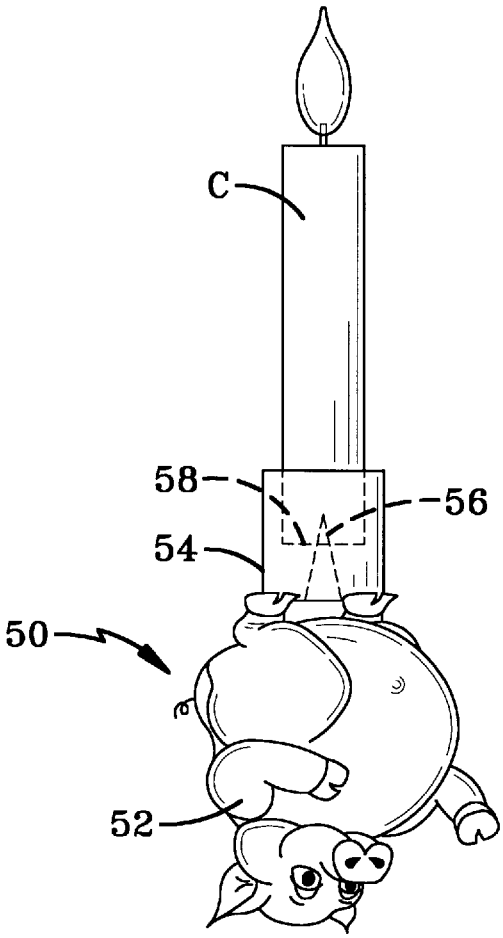
FIG. 7 is a front view of a preferred embodiment of the invention having an upwardly extending pin in the candle holder portion.
Figure 13:
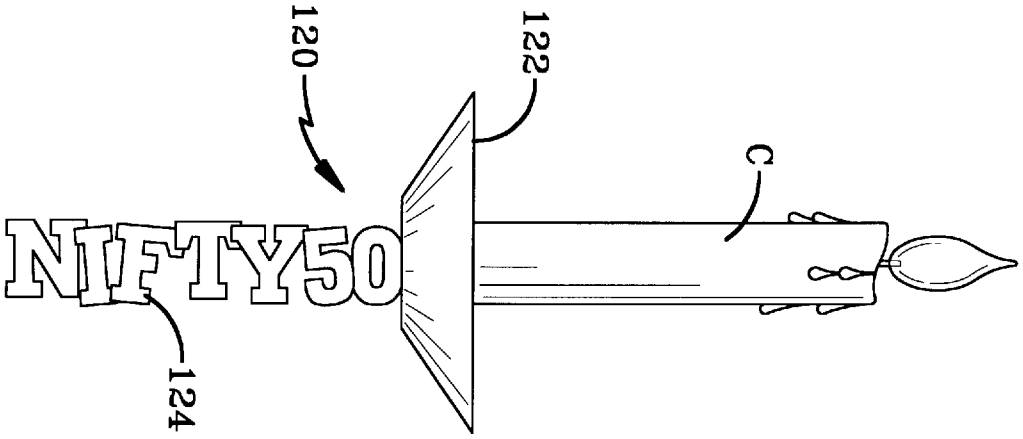
FIGS. 13–16 are front views of preferred embodiments having various types of toy surprise portions.
Figure 14:
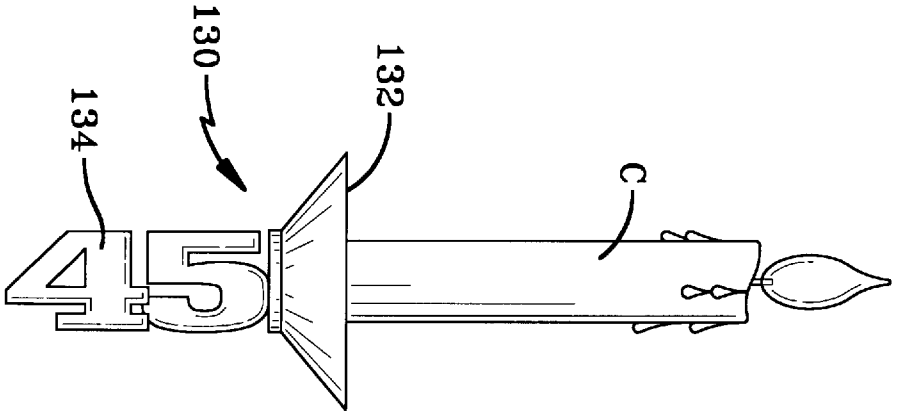
Figure 15:
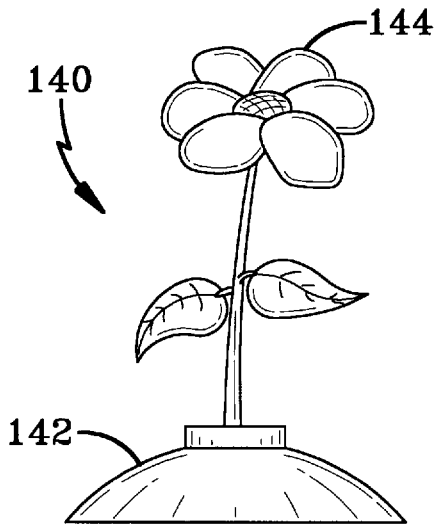
Figure 16:
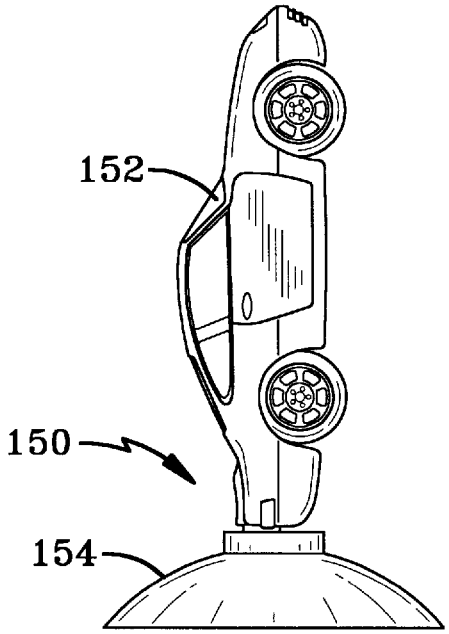

Another aspect of the preferred embodiment of the invention is shown in FIG. 6, which shows a candle holder toy surprise 40 having a toy surprise portion 42 and a candle holder portion 44. Candle holder portion 44 is cylindrical in shape and includes a series of upwardly extending fingers 46 for holding and securing the candle For Example, FIG. 13 shows a two-in-one candle holder toy surprise 120 having a candle holding portion 122, similar to candle holder portion 92 in FIG. 11. Toy surprise portion 124 is in the form of a series of alphanumeric characters forming the phrase "NIFTY50". FIG. 14 shows a two-in-one candle holder toy surprise 130 having a candle holding portion 132, similar to candle holder portion 84 in FIG. 10. Toy surprise portion 134 is in the form of a series of numbers forming the phrase "45". It should be appreciated that the toy surprise portion can also take on an inanimate object form, such as shown in FIG. 15 and FIG. 16. FIG. 15 shows a two-in-one candle holder toy surprise 140 including a toy surprise portion shaped as a flower, while FIG. 16 shows a two-in-one toy holder toy surprise portion 150 having a toy surprise portion 152 shaped in the form of a vehicle. Both two-in-one candle holder toy surprise 140 and 150 have a candle holding portion 142 and 154, respectively similar to candle holding portion 6 shown in FIGS. 1–3. C when the candle is inserted into candle holder portion 44. As can be seen in FIG. 7, a candle holder toy surprise 50 includes toy surprise portion 52. A candle holder portion 54 includes a cavity 58 for receiving candle C. A pin 56 extending in an upward direction inside the cavity penetrates the candle and holds and secures the candle to candle holder portion 54.

Figure 8:
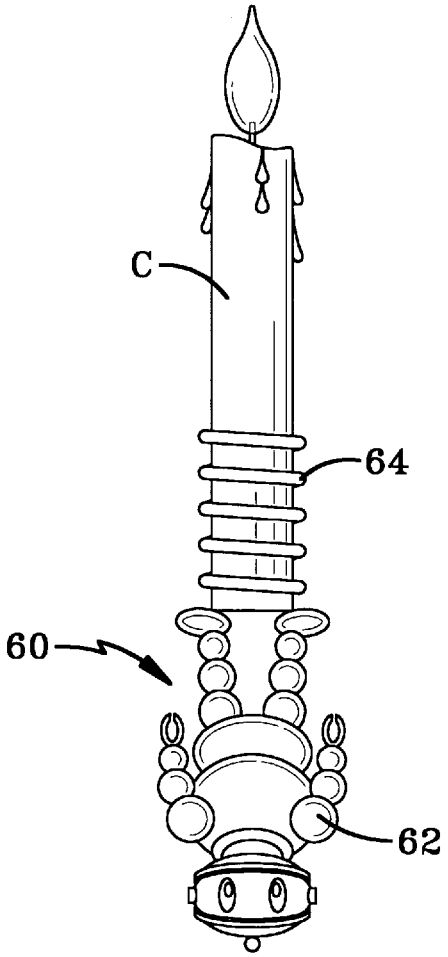
FIG. 8 is a front view of a preferred embodiment of the invention, having the candle holder portion formed from a coil.
Figure 9:
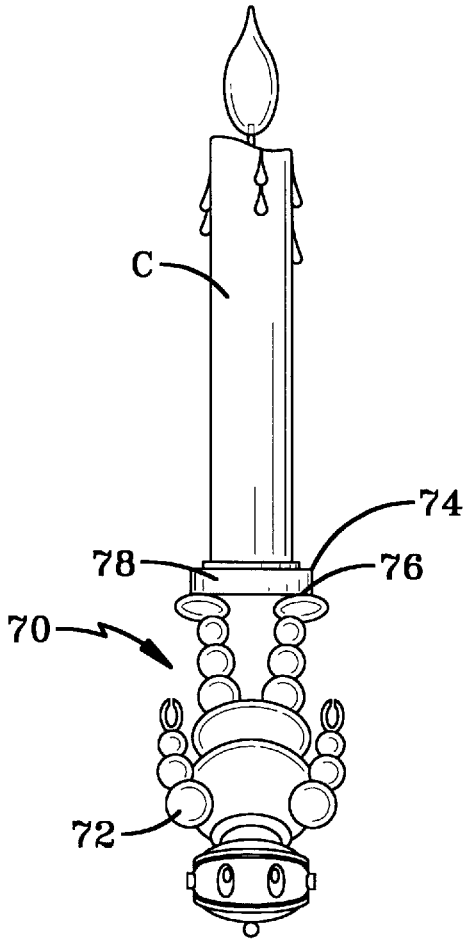
FIG. 9 is a front view of a preferred embodiment of the invention, where the candle holder portion has a circular base and an adhesive pad on top of the base.

The candle holder toy surprise is not limited to candle holders having cylindrical cavities for receiving the candle. As shown in FIG. 8, a candle holder toy surprise 60 includes a toy portion 62 and a candle holder portion 64. Candle holder portion 64 is comprised of a coil or spring that receives the bottom end of a birthday candle. FIG. 9 shows a candle holder toy surprise 70 having a toy portion 72 and a candle holder portion 76. Candle holder portion 76 is comprised of a circular base 78 and a circular adhesive pad 74. Adhesive pad 74 could be of the type where the plastic cover is peeled away to reveal an adhesive coated surface. A candle C is placed on the base 78 of candle holder portion 76 and held in place by adhesive pad 74.

Figure 10:
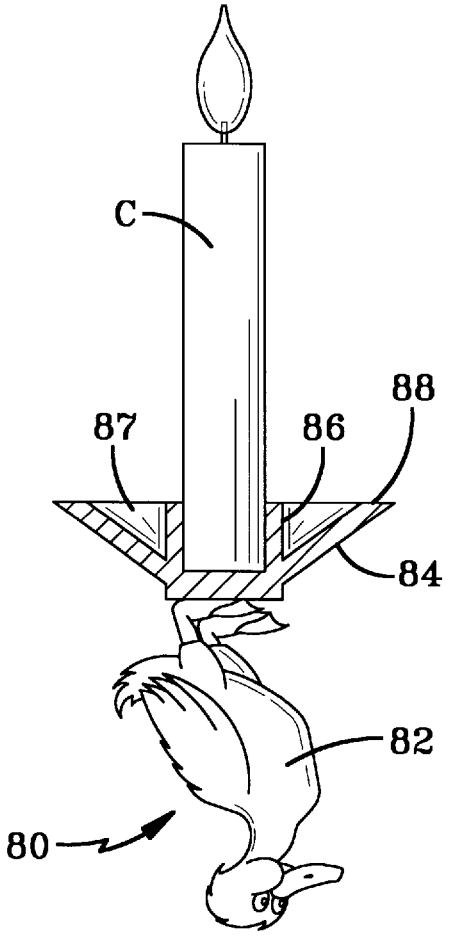
FIG. 10 is a front, cross sectional view of a preferred embodiment having a candle holder portion having a bowl-like shape.
Figure 11:
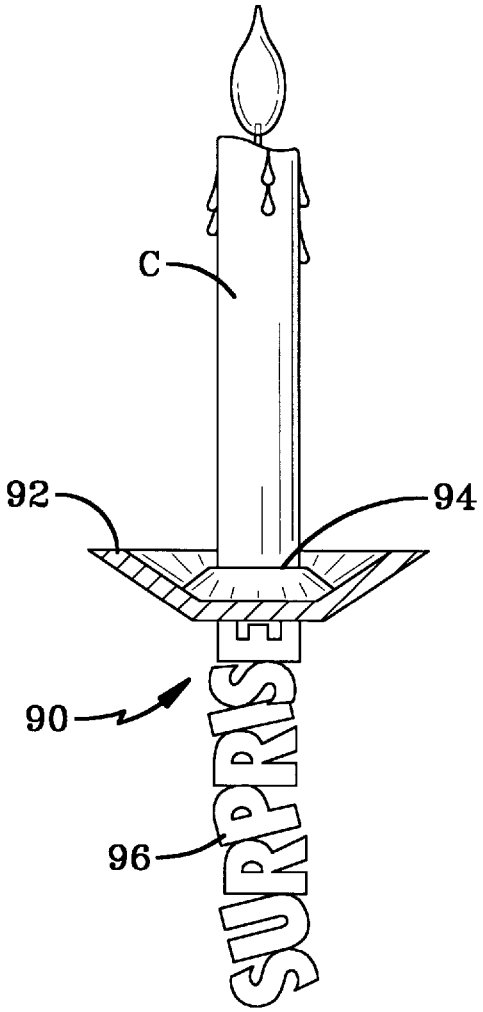
FIG. 11 is a front, cross sectional view of a preferred embodiment having a toy surprise made of alphabet characters.

As can be appreciated these different features as described can be combined as shown in FIG. 10 and FIG. 11. FIG. 10 displays a candle holder toy surprise 80 having a toy surprise 82 and a bowl shaped candle holder portion 84. Candle holder portion 84 has an inner cavity 86 having an inner diameter sized to receive and hold a candle C. Candle holder portion 84 has an outer diameter 88 and a rounded surface sloping downwardly to inner cavity 86 forming an inner cavity area 87 between outer diameter 88 and inner cavity 86. Inner cavity area 87 is adapted for catching dripping wax as the candle C bums down. FIG. 11 shows a candle holder toy surprise 90 having a candle holder portion 92 shaped like a bowl. The bowl shape ensures that any melted wax falls in the candle holder and not on the cake. Adhesive 94 is placed in candle holder portion 92 for holding candle C in place. The invention is not limited to animated characters or objects. Candle holder toy surprise 90 includes toy surprise portion 96 that is in the form of a series of letters spelling the word "SURPRISE". As should be appreciated, the toy surprise portion could take on many different combinations of alphabet, numeric or alpha-numeric characters such as "HAPPYBIRTHDAY", "OVERTHEHILL", "45", "LORDYYOUR40", "NIFTY50".

Figure 12:
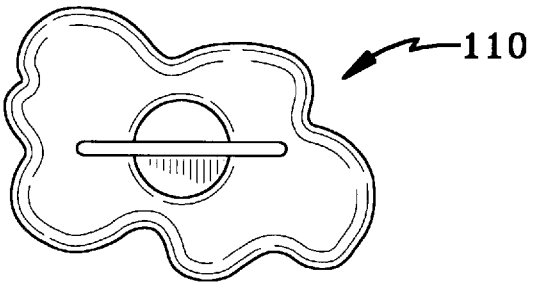
FIG. 12 is a top view of a preferred embodiment of the invention having an asymmetrical candle holder portion.

It should also be appreciated that the candle holder portion is not limited to circular symmetrical shapes and can be triangular, rectangular, hexagonal or any other symmetrical or asymmetrical shape. As can be seen in FIG. 12, candle holder portion 110, is shaped asymmetrically.

When the present invention is used to secure birthday candles in a birthday cake in the way described above, several entertaining and fun games can be played by the children celebrating a birthday. A first game that can be played consists of using different candle holders with different toy figures, where one of the figure toys is selected as the winning toy surprise. The figure toys and candle holders are then inserted into the cake without the children knowing where the target figure toy is hidden. The children then take turns guessing and pulling the candle holders from the cake. The child who guesses right and finds the target figure toy wins. Another fun game that can be played consists of using different candle holders with different figure toys where each figure toy has an identical twin. Children celebrating a birthday can then take turns pulling two candle holders every turn, trying to find a pair of identical figure toys. If a child pulls a couple of candle holders and fails to find a pair of identical figure toys, the child must put them back in the cake. If the child finds an identical pair of figure toys, the child can keep them. The child who gets the most pairs of identical figure toys wins.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A two-in-one candle holder toy surprise apparatus having a candle holding mode when in an upright position and inserted in a cake and having a toy mode when in an inverted position, said apparatus comprising:

a candle holder portion having a bottom surface and including securing means for securing and holding a candle when in the candle holding mode; and a toy surprise portion having a base attached to said bottom surface of said candle holder portion, said toy surprise portion functioning as a toy when said apparatus is in the toy mode and as an anchor for said candle holder portion when the toy is inserted into the cake when said apparatus in the candle holding mode.

2. A two-in-one candle holder toy surprise apparatus as defined in claim 1, wherein said securing means is a socket cavity for receiving a candle, said socket cavity being inside said candle holder portion.

3. A two-in-one candle holder toy surprise apparatus as defined in claim 2, wherein said socket cavity has a longitudinal axis and is comprised of at least two sets of flanges, each set being concentric about said axis and being disposed to hold candles of various diameters.

4. A two-in-one candle holder toy surprise apparatus as defined in claim 1, wherein said securing means is comprised of a plurality of fingers extending upwardly for surrounding and supporting a candle when the candle is inserted in said candle holder portion.

5. A two-in-one candle holder toy surprise apparatus as defined in claim 1, wherein said securing means is comprised of a pin extending upwardly from said candle holder portion for piercing the bottom surface of a candle when the candle is received by said candle holder portion.

6. A two-in-one candle holder toy surprise apparatus as defined in claim 1, wherein said securing means is comprised of a coil for receiving a candle when the candle is inserted into said candle holder portion.

7. A two-in-one candle holder toy surprise apparatus as defined in claim 1, wherein said securing means is comprised of adhesive affixed to said bottom surface.

8. A two-in-one candle holder toy surprise apparatus as defined in claim 1, wherein said candle holder portion has a bowl-like shape with an outer diameter substantially larger than the diameter of a candle received in said candle holder portion, wherein said candle holder portion catches wax drippings when the candle burns.

9. A two-in-one candle holder toy surprise apparatus as defined in claim 1, wherein said toy surprise portion is generally flat in the longitudinal direction for enabling said surprise portion to easily pierce the cake.

10. A two-in-one candle holder toy surprise apparatus as defined in claim 1, wherein said toy surprise portion has an irregular shape.

11. A two-in-one candle holder toy surprise apparatus as defined in claim 1, wherein said toy surprise portion is in the shape selected from the group consisting of cartoon characters, animals, flowers, and vehicles.

12. A two-in-one candle holder toy surprise apparatus as defined in claim 1, wherein said toy surprise portion is in the shape of a group of alpha-numeric characters.

13. A two-in-one candle holder toy surprise apparatus as defined in claim 1, wherein said toy surprise portion is in the shape of a group of alphabet characters.

14. A two-in-one candle holder toy surprise apparatus as defined in claim 1, wherein said toy surprise portion is in the shape of a group of numeric characters.

15. A two-in-one candle holder toy surprise apparatus as defined in claim 1, wherein said toy surprise portion is formed from material selected from the group consisting of plastic, metal, paperboard, wood, and glass.

16. A two-in-one candle holder toy surprise apparatus as defined in claim 1, wherein said candle holder portion functions as a stand for the toy surprise portion when said apparatus in said toy mode.

17. A two-in-one candle holder toy surprise apparatus as defined in claim 1, wherein said candle holder portion has an asymmetrical shape.

* * * * *